United States Patent [19]

Zani

[11] Patent Number: 4,621,866

[45] Date of Patent: Nov. 11, 1986

[54] ARMCHAIR STRUCTURE HAVING AN ADJUSTABLE ANATOMICAL CONFIGURATION

[76] Inventor: Giuseppe Zani, Via Enrico Toti, 13, 20039 Varedo (Milano), Italy

[21] Appl. No.: 760,954

[22] Filed: Jul. 31, 1985

[30] Foreign Application Priority Data

May 17, 1985 [IT] Italy ..... 21854/85[U]

[51] Int. Cl.[4] ..... A47C 3/00

[52] U.S. Cl. ..... 297/284; 297/373; 297/440

[58] Field of Search ..... 297/284, 460, 373, 459, 297/458, 440

[56] References Cited

U.S. PATENT DOCUMENTS

| | | | |
|---|---|---|---|
| 318,250 | 5/1885 | Hildebrand | 297/373 |
| 3,379,472 | 4/1968 | Hilfiker | 297/284 X |
| 3,404,915 | 10/1968 | Filho | 297/373 |
| 3,877,750 | 4/1975 | Scholpp | 297/284 |
| 4,484,782 | 11/1984 | Larson | 297/458 |

FOREIGN PATENT DOCUMENTS

| | | | |
|---|---|---|---|
| 2723722 | 12/1978 | Fed. Rep. of Germany | 297/460 |

*Primary Examiner*—Francis K. Zugel

*Attorney, Agent, or Firm*—Bucknam and Archer

[57] ABSTRACT

An armchair structure having an adjustable anatomical configuration comprises two lateral stringer assemblies (2) composed of sets of interlinked articulation elements (3) each of which is constituted by flat plate part (4) having connector portions (5,6) at each end. Each connector portion (5,6) has a central aperture (8) radially from which extend serrations (7) so formed that the serrations on a first connector portion (5) are formed on one face of the plate part (4) and the serrations on a second connector portion (6) are formed on the opposite face whereby adjacent articulation elements (3) can be interconnected by face-to-face engagement of cooperating first and second connector portions (5,6). A clamping bolt secures these connector portions together in a selected relative orientation.

1 Claim, 11 Drawing Figures

Fig. 1
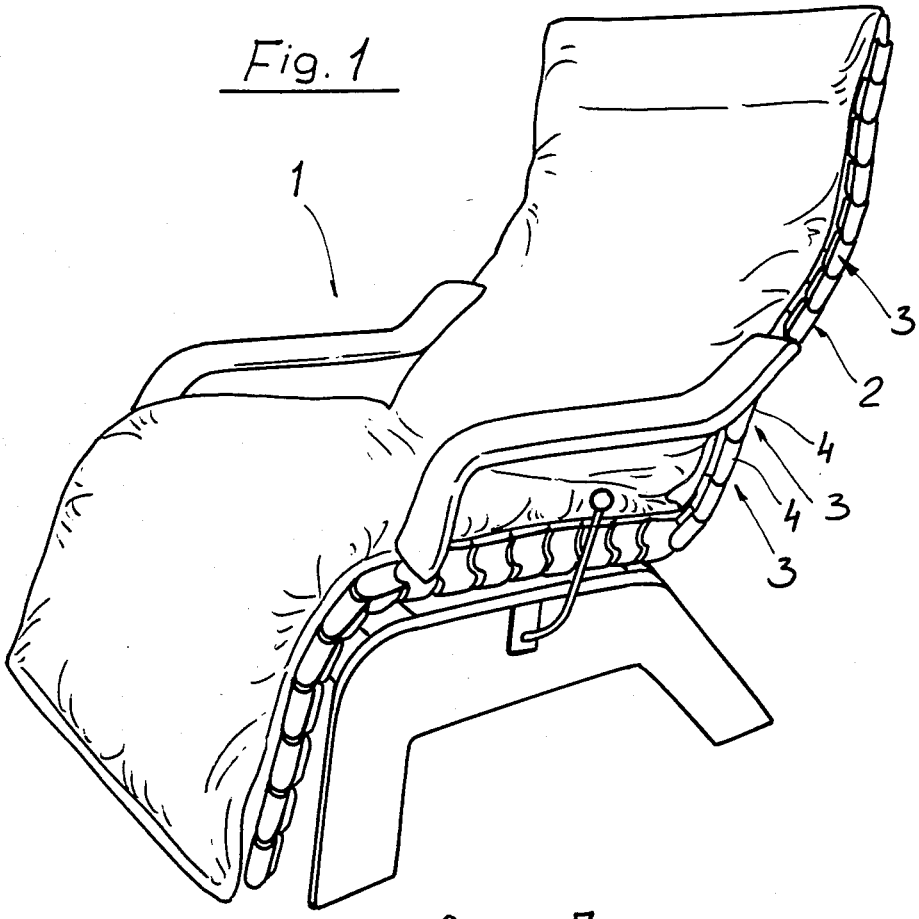
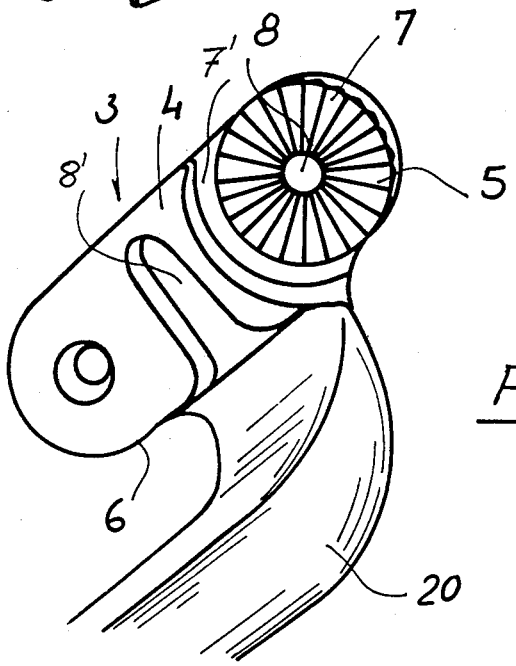
Fig. 4

3
4
5
6
7
7'
8
8'
10
20

4
3
20

21
20
5
6
3
4
20
3

20
21

ARMCHAIR STRUCTURE HAVING AN ADJUSTABLE ANATOMICAL CONFIGURATION

The present invention relates to an armchair structure having an adjustable anatomical configuration.

Armchairs having a so-called "anatomical" configuration are already currently available on the market. The manufacture of such armchairs has been beset with problems, however, in that it has been necessary to make each armchair individually with its own unique framework, which constitutes the supporting structure of the armchair, in order to obtain the desired anatomical configuration.

Another disadvantage of the prior art, is constituted by the fact that, as well as the significant constructional problems, previous such armchairs do not allow the user to modify at will the configuration in such a way as to be able easily to adapt it to a shape other than that in which it was originally made, for example to adapt it to his own shape if this differs from the original anatomical configuration of the chair.

A further disadvantage lies in the fact that, generally anatomical armchairs have not been sufficiently robust and sturdy so that these have not always been well accepted by users.

The present invention seeks to overcome the above indicated disadvantages of the prior art by providing an armchair structure having a variable anatomical configuration, which will provide the possibility of assembling a framework of an armchair by using simple elements which are all the same as one another, and which can be rapidly connected and orientated in such a way as to obtain a desired armchair configuration.

According to the present invention, there is provided an armchair structure having an adjustable anatomical configuration, characterised by the fact that it comprises a supporting framework having lateral stringers constituted by a plurality of interconnected articulation elements, each articulation element having at its ends, a first connector portion and a second connector portion so shaped that a first connector portion of one articulation element is connectable to a second connector portion of an adjacent articulation element in such a way that adjacent pairs of articulation elements can be disposed at a selected relative inclination with respect to one another, and fixedly secured in that relative inclination.

A particular advantage of armchairs made in accordance with the invention is that they have an adjustable anatomical configuration, which allows the user to make desired adjustments with simple and rapid means.

Another advantage of the present invention is that it provides an armchair structure having an adjustable anatomical configuration, which can be easily made in various widths required, without the necessity of having to modify details of the major constituent elements. The present invention also offers the advantage of providing an armchair structure having an adjustable anatomical configuration which, by its particular constructional characteristics is able to offer the widest guarantees of reliability and security in use.

The present armchair structure of the present invention is easily obtainable starting from materials which are commonly commercially available and is, moreover, competitive from a purely economic point of view.

One embodiment of the invention will now be more particularly described by way of example with reference to the accompanying drawings, in which:

FIG. 1 is a perspective view of an armchair having an adjustable anatomical configuration, formed as an embodiment of the invention;

FIG. 4 is a perspective view of an articulation element constituting part of the structure of the embodiment illustrated in FIGS. 1 to 3;

Figure 3:
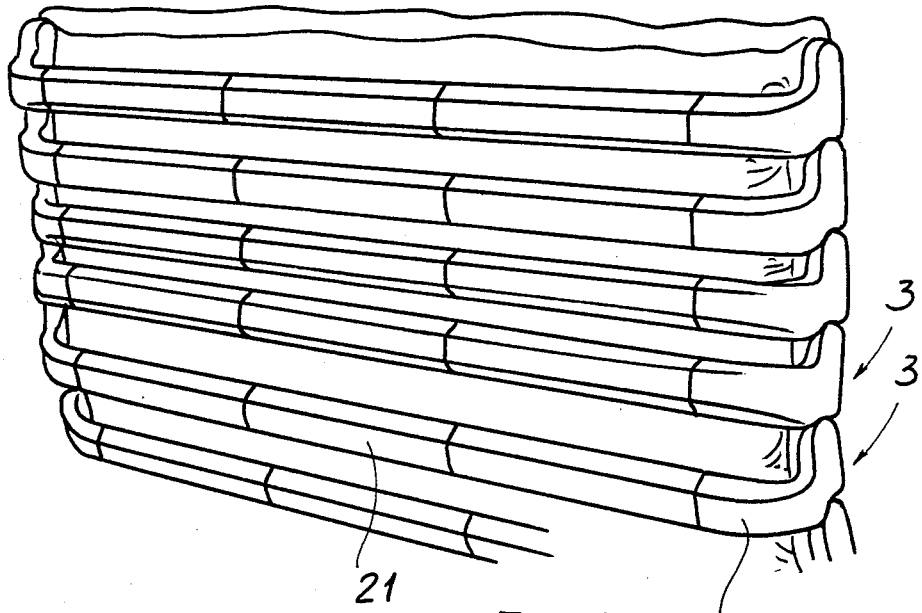
FIG. 3 is a perspective rear view of the chair back illustrated in FIG. 2.
Figure 2:
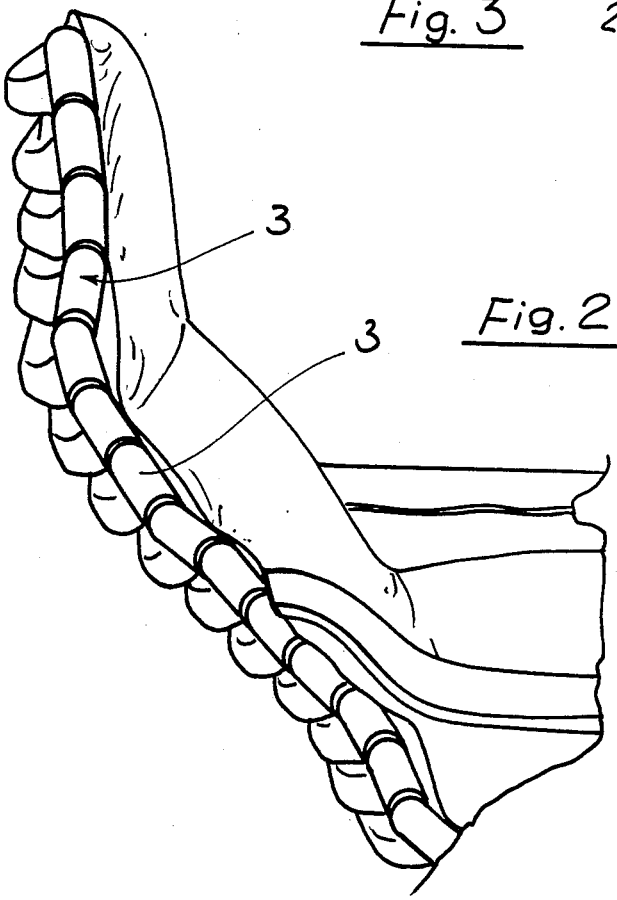
FIG. 2 is a side view of the chair back of the armchair of FIG. 1.

With reference now to the drawings, the armchair structure is generally indicated with the reference numeral 1, and has a body supporting framework constituted by a pair of lateral stringers each generally indicated with the reference numeral 2, composed of a plurality of interconnected articulation elements 3 illustrated in more detail in FIG. 4. These articulation elements 3 are shaped so that they can be connected together in such a way as to be able to assume a selected relative inclination in dependence on the anatomical configuration which it is desired to achieve.

In more detail, each articulation element 3 comprises a flattened elongate plate 4 which, at one end, has an upper connector portion 5 and at the other end a lower connector portion 6 such connector portions 5 and 6 being each provided with a face having radial serrations 7 in the form of teeth which extend radially from a central aperture 8. The serrations 7 of the connector portions 5 and 6 face in opposite directions with respect to one another, that is to say the radial teeth are formed on oppositely directed faces in such a way as to allow the connection of an upper connector portion 5 of a given articulation element with the lower connector portion 6 of an articulation element 3 disposed above it in a row, and, similarly, the coupling of the lower connector portion 6 of a given articulation element with the upper connector portion 5 of an articulation element 3 disposed below it in the row.

As it should be apparent from the Figures (see for example FIG. 4) the serrated faces of the connector portions 5 and 6 are defined by two substantially circular end portions which occupy the main part of the plate 4, the radial serrations 7 being recessed and a grooved not serrated portion 7' being formed encompassing a part of the circumpherential contour of each serrated end portion toward the central portion of the flattened plate 4. Thus the two end serrated portions are arranged at a small spacing from one another and, more specifically, the distance of the inner edge of the two grooved not serrated portions substantially corresponds to a radius of a said circular end serrated portion. It should moreover be noted that a substantially bell-shaped opening 8' is defined at the middle of the flattened plate 4.

To obtain a stable coupling there is provided a through bolt 10 with an associated clamping nut which allows the connector portions 5 and 6 to be fixed together after these have been positioned with the desired inclination, in such a way as to obtain a connection in which the individual plates 4 of adjacent articulation elements 3 have a mutual inclination which is adjustable at will.

From each flattened plate 4 extends an interconnection element indicated at 20 which lies in a substantially perpendicular direction with respect to the plane in which the plate 4 lies. These interconnection elements allow rapid connection to be made with suitable cross members 21 which can be made to any desired length thus offering the possibility of obtaining armchairs of different widths without having to produce any modifications of the main constituent elements.

Figures 5, 6, 7:
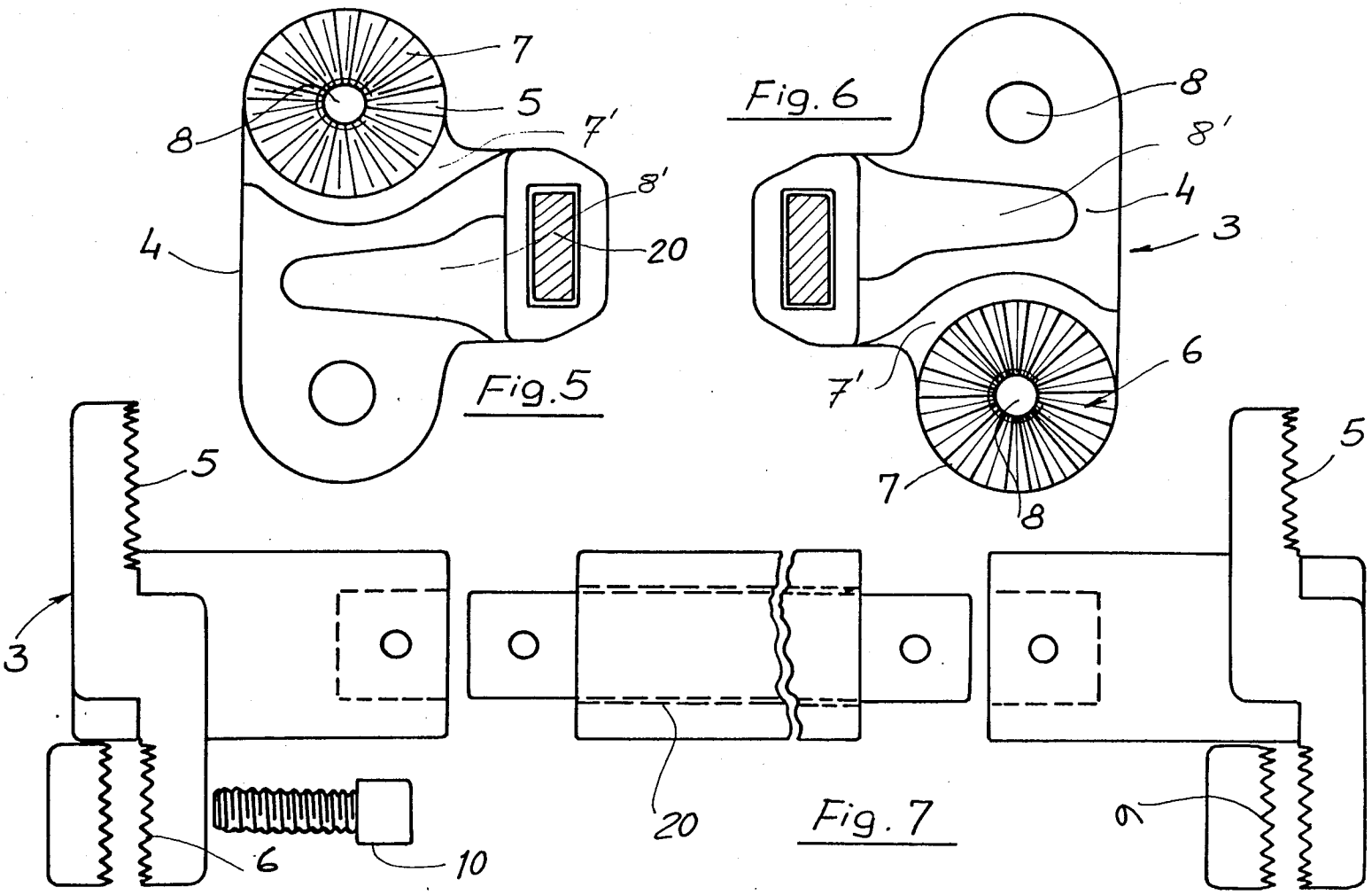
FIG. 5 is a schematic side view of the articulation element, seen from one side.
FIG. 6 is a side view of the articulation element seen from the other side.
FIG. 7 is a schematic front view showing two articulation elements and a connecting cross member.
Figure 8:
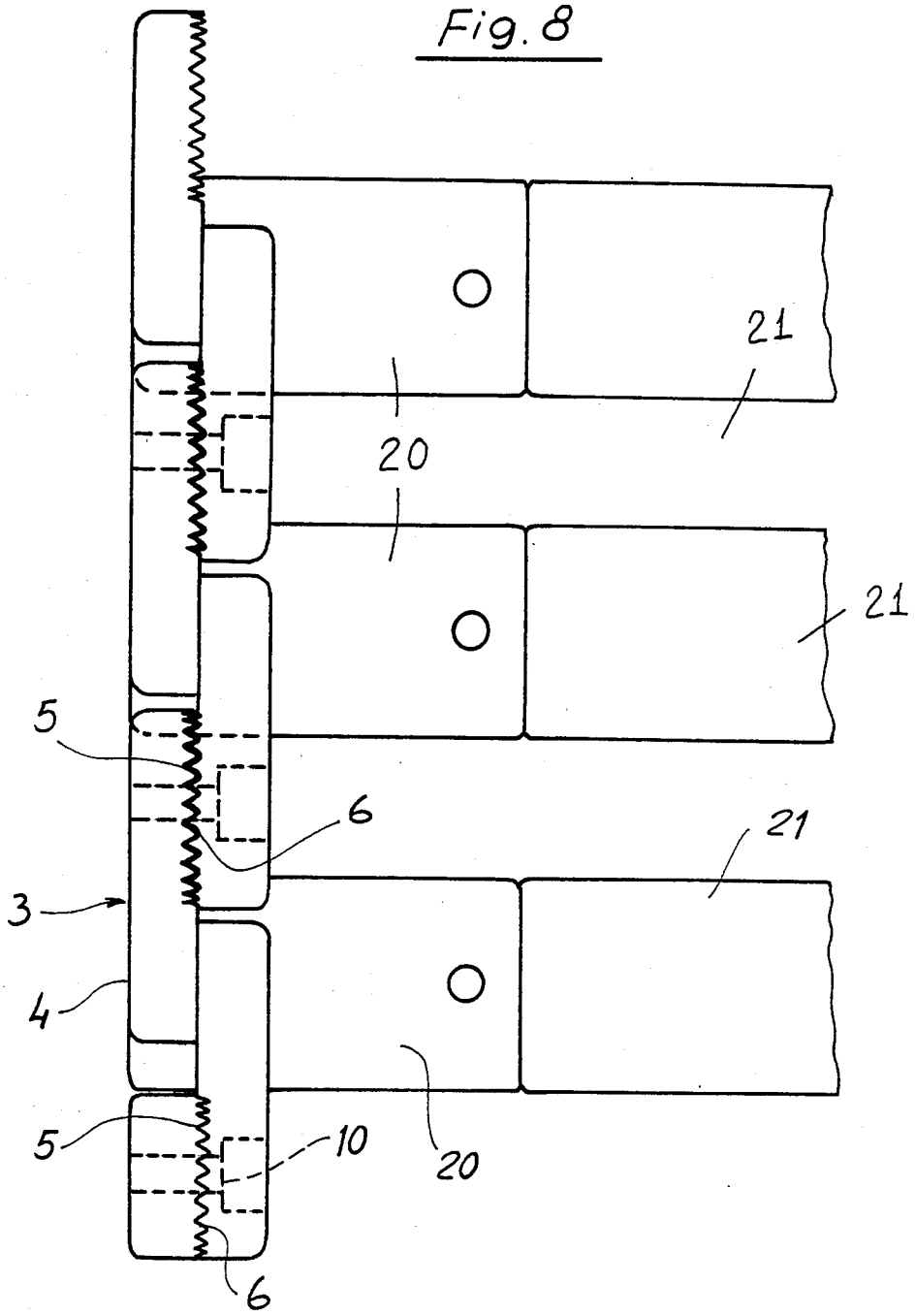
FIG. 8 is a similar front view showing a part of a chair back.
Figures 9, 10, 11:
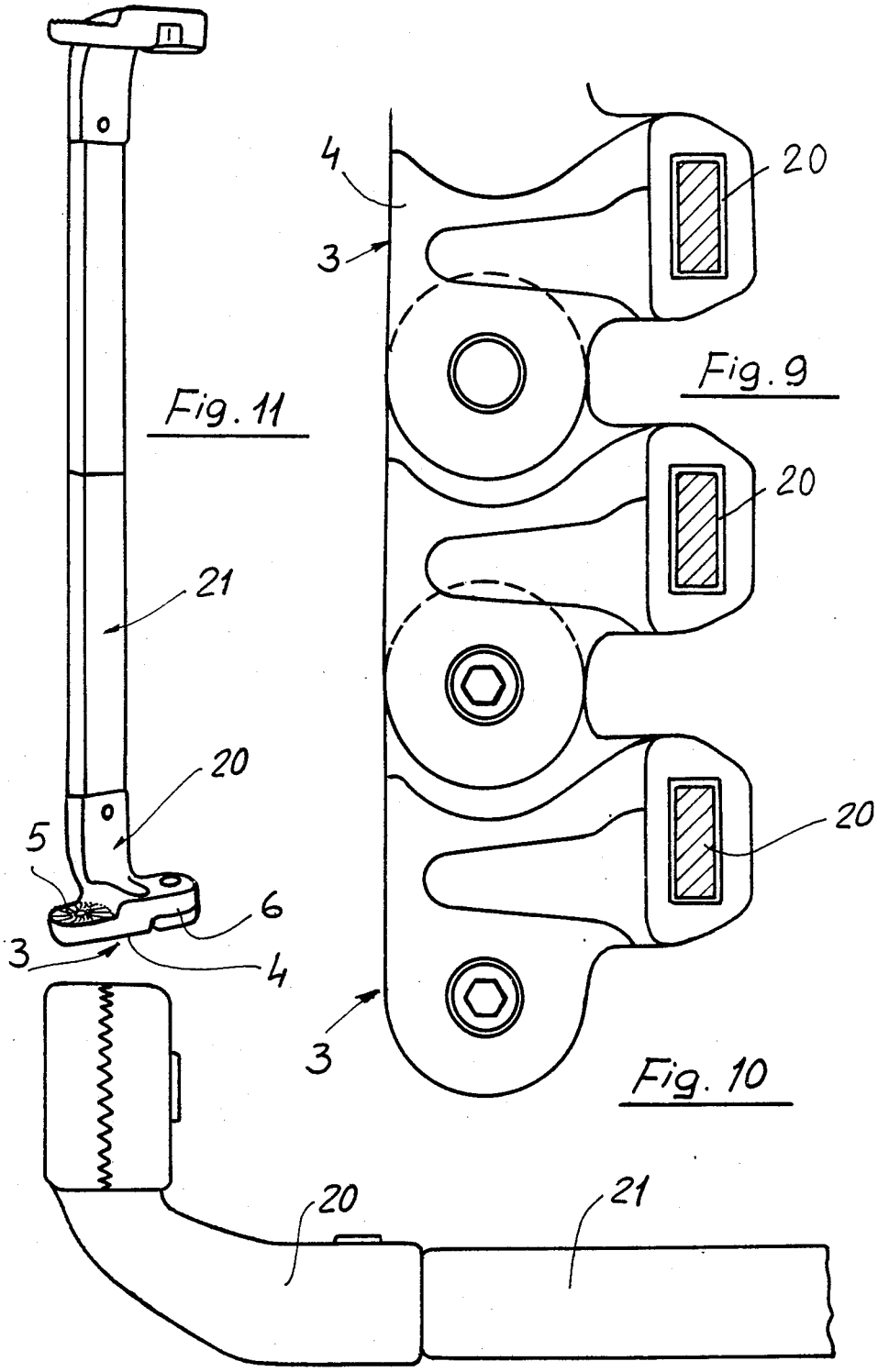
FIG. 9 is a sectional side view showing some of the articulation elements constituting a chair back in the relative position they adopt upon assembly of a chair.
FIG. 10 is a schematic view showing an articulation element with the end of a cross member connected thereto.
FIG. 11 is a perspective view of a cross member connected at its end to two articulation elements.

As shown in the figures (see for example FIGS. 4, 5 and 6) the interconnection element 20 is of substantially sleeve shape and is formed in a single piece with the respective flattened plate therefrom it perpendicularly extends; in particular it should be moreover pointed out that the width of said interconnection element is such as to extend substantially from the center of one of said end circular serrated portions to the center of the other end circular serrated portion of the flattened plate 4. Thus, as the articulation elements are mutually coupled, a small distance will be left between adjacent elements 20 and cross members 21, thereby back resting and sitting surfaces can be obtained effective to support a person with a great comfort, by simply providing a covering cloth (FIG. 1) to be laid directly on the cross elements 21.

In practice, once the anatomical configuration which it is desired to assume has been obtained by relative adjustment of the articulation elements 2, it is sufficient to clamp the various bolts 10 in such a way as to fit the coupling of the various articulation elements, thus securing the armchair in the desired configuration.

It is emphasised that the use of the articulation elements 2 described hereinbelow gives the possibility of obtaining a rapid assembly of the armchair framework, to which a selected anatomical configuration can be conferred with rapidity and ease, whilst always having the certainty of the secure coupling when the various elements which are clamped together by the appropriate bolts.

An important advantage of the invention from an economic point of view, is constituted by the fact that the connector elements allow the utilisation of cross members having any selected length so that an armchair of any desired width can be made.

What is claimed is:

1. An armchair structure having an adjustable anatomical configuration, comprising:

a supporting framework having a stringer assembly along each side, each said stringer assembly being constituted by a plurality of interconnected articulation elements, each said articulation element being shaped at one end to form a first connector portion and at the other end to form a second connector portion, said first connector portion of one articulation element being connectable to said second connector portion of an adjacent said articulation element in a said stringer assembly said connection between adjacent pairs of said articulation elements allowing said articulation elements to be disposed at a selected relative inclination with respect to one another, each said articulation element including a flattened elongate plate part which is formed at its ends with said first and second connector portions, each of said first and second connector portions having a central aperture passing therethrough and a plurality of serrations formed on one face thereof, said serrations extending radially outwardly from said aperture and said serrations of said first connector portion being formed on one face of said plate whilst said serrations of said second connector portion being formed on the opposite face of said plate such as to allow face-to-face coupling of said first and second connector portions of adjacent said articulation elements, said connector portion being defined by two substantially circular end portions which occupy the main part of said plate, said radial serrations being recessed and a grooved not serrated portion being formed encompassing a part of the circumpherential contour of each said end portion toward the central portion of said plate, said two end portions being arranged at a distance substantially corresponding to a radius of a said circular end portion, cooperating said connector portions of adjacent said articulation elements being secured together by a clamping bolt passing through said apertures in said connector portions whereby to fix said connector portions together with said facing serrations thereof in engagement with one another, each said articulation element having a cross member sleeve shaped connector formed in a single piece therewith and extending from a mid portion thereof, for connection to a respective cross member of a set thereof joining said two lateral stringer assemblies together, said cross member connector extending from a median zone of said flat plate part in a direction substantially perpendicular to the plane in which said flat plate part lies, substantially parallel to the axes of said apertures in said connector portions, the width of said cross member connector spanning substantially from the center of one said end portion to the center of the other.

* * * * *